United States Patent [19]

Lemaire

[11] 4,044,960

[45] Aug. 30, 1977

[54] PROCESS AND APPARATUS TO WIND THREAD ON A SUCCESSION OF REELS

[75] Inventor: Roland Lemaire, Fere-en-Tardenois, France

[73] Assignee: Etudes et Fabrications, France

[21] Appl. No.: 690,395

[22] Filed: May 27, 1976

[30] Foreign Application Priority Data

May 29, 1975 France ..... 75.16849

[51] Int. Cl.[2] ..... B65H 54/00

[52] U.S. Cl. ..... 242/25 A

[58] Field of Search ..... 242/25 A, 25 R, 18 A

[56] References Cited

U.S. PATENT DOCUMENTS

| | | | |
|---|---|---|---|
| 2,946,529 | 7/1960 | Stem | 242/25 A |
| 3,083,923 | 4/1963 | Taylor | 242/25 A |
| 3,814,340 | 6/1974 | Maillefer | 242/25 A |
| 3,971,519 | 7/1976 | Ikegami | 242/25 A |

*Primary Examiner*—Edward J. McCarthy

*Attorney, Agent, or Firm*—Kane, Dalsimer, Kane, Sullivan and Kurucz

[57] ABSTRACT

A method and an apparatus to wind a thread on a succession of reels carried by coaxial annuli provided with a clamp member to couple the thread to the reel, the switching-over of the thread from a filled reel to an empty reel being initiated after the detection, by way of a detector, of a predetermined angular position with respect to an associated anvil of the clamp member fixed on the annulus carrying the empty reel.

This method and apparatus are for example used to wind electric insulated wire comprising a metallic core around reels.

9 Claims, 5 Drawing Figures

PROCESS AND APPARATUS TO WIND THREAD ON A SUCCESSION OF REELS

The invention relates to a process and an apparatus to wind a thread on a succession of reels having parallel axes.

More particularly, the invention relates to a winding apparatus of the kind comprising two crown reels or annuli with parallel practically horizontal axes, each supporting a reel or bobbin, a reel traversing mechanism with a pulley movable above said reels and adapted to feed the thread in regular layers, means for cutting the thread when the first reel has been filled to capacity and means to then ensure without stopping the winding of the thread around a second reel.

In the known apparatus of this type, the switching-over of the thread from the first full reel to the second empty reel is made when the length of thread wound around the first reel has reached a predetermined value, a servomechanism bringing then the pulley of the traversing mechanism above the second reel. The thread is positioned tangentially to the flange of the rotating empty reel and at the same time continues to be wound around the full reel. A catch pin positioned between the two reels is then put into motion and pulls the thread backwards; the thread is then coupled to the flange of the empty reel, by a clamp member situated at the periphery of the annulus associated with the empty reel.

The thread is then cut on an anvil placed near the periphery of the same crown wheel. The remaining length of thread is then wound around the filled reel, and at the same time the winding of the thread on the second reel begins.

The thread is hence carried from one side to the other side of a vertical plane in which the projected end or nose of the clamp member turns at a high speed, for example at a speed of 4000 RPM, before being gripped by the clamp member, and then cut.

A risk of meeting between the projected end of the clamp member and the thread hence exists during this process. This risk is all the more higher in that the travel speed of the thread is slow with respect to the rotation speed of the clamp member. In fact, experiments show that in 1 or 2 percent of the travel process the projected end of the clamp member catches the thread, which results in unwanted breakage of the thread. When this occurs, the winding process has to be stopped, which increases the utilization price of the winding apparatus; also a certain length of thread has to be thrown away.

It is an object of the invention to provide a process and an apparatus avoiding this drawback and in which all risks of meeting between the clamp member and the thread is suppressed.

The process of the invention relates to the winding of a thread on a succession of reels carried by coaxial annuli set into rotation, each of those comprising a peripheral clamp member to catch the thread and couple it to the associated reel, fixed anvils being provided to cut the thread at the end of the filling of a reel.

Following the invention, the process is characterized in that the switching of the thread from the full reel to the empty reel is initiated when a predetermined angular position with respect to the associated anvil of the clamp member supported by the annulus associated with the empty reel has been detected.

A signal which controls the travel of the thread is then created at an instant corresponding to the detected position of the clamp member, taking into account the length of time necessary to the switching of the thread inside the clamp member.

Following a way of realisation of this process, the travel of the thread is initiated immediately after the detection of the passage of the clamp member at the level of the anvil, in such a way that the travel of the thread is executed before a new complete rotation of the clamp member. Hence, any risk of meeting between the thread and the projected end of the clamp member is set aside.

The apparatus of the invention, in particular to carry out the precited process, is characterized in that it comprises means to detect a predetermined angular position of the clamp member supported by the annulus associated with the reel to be filled, its angular position being measured with respect to the associated anvil, and means to initiate the travel of the thread inside the clamp member immediately after this detection.

Other particular features and advantages of the invention will be made clearer in the following detailed description, made with reference to the accompanying drawings, wherein.

Figure 1:
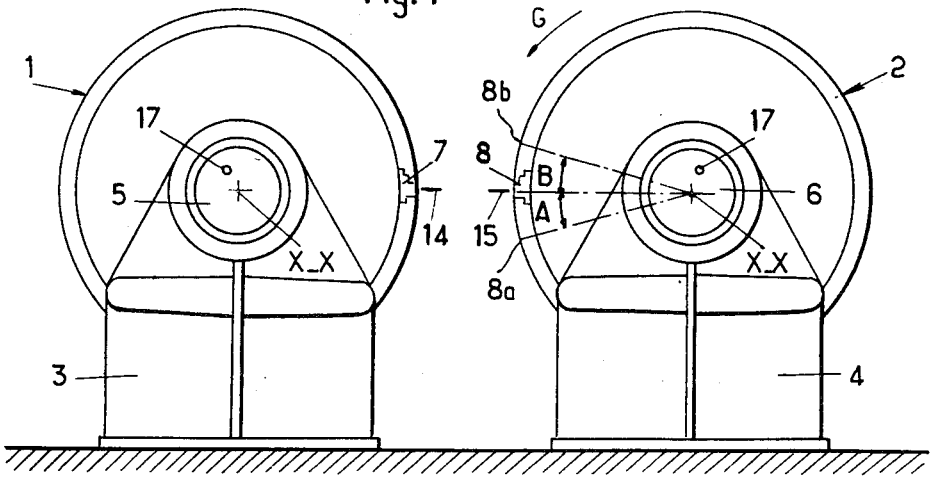
FIG. 1 is a diagrammatic view in elevation of an example of a realisation of the winding apparatus of the invention.
Figure 2:
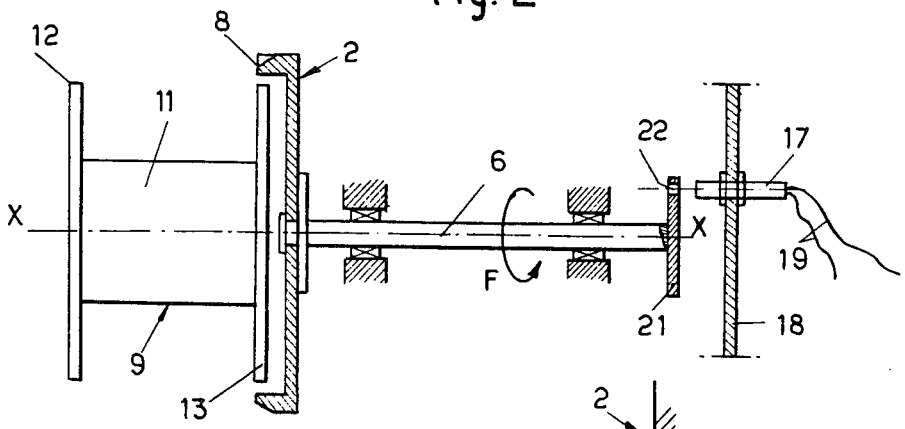
FIG. 2 is a diagrammatic partial side view of the winding apparatus of FIG. 1.
Figure 3:
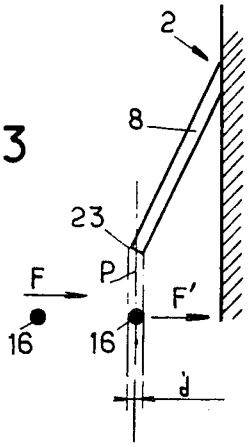
FIG. 3 is a partial view in elevation showing the respective positions of the gripping jaw and of the thread during the travel of the thread.

In the example of realisation shown on FIGS. 1 to 3, the winding apparatus comprises two annuli 1 and 2, supported by the frames 3 and 4. The axes X—X of the annuli 1 and 2 are parallel and horizontal, and the annuli are rotated by the shafts 5, 6 which are parallel to the axis of the annuli 1 and 2. The shafts 5 and 6 are set into rotation by means which are known in themselves and which are not shown. The annuli 1 and 2 are fitted with peripheral clamp members respectively 7 and 8, those being provided to allow the coupling of the thread on the empty reel associated with the annulus.

Each annulus 1 and 2 carries a reel coaxial with itself; only the reel 9 associated with the annulus 2 on FIG. 2 is shown. The reel 9 comprises a cylindrical drum 11 limited on both sides by two circular flanges 12, 13.

Each annulus 1 and 2 is associated, in an already known way, with a fixed anvil 14 and 15 situated on a stand not shown at the level of the axis X—X and near the peripheral part of the associated annulus 1 or 2. The anvils 14, 15 are provided for the cutting of the thread 16 (FIG. 3) when this thread has been gripped by the clamp member 7 or 8.

The winding apparatus comprises also a reel traversing mechanism which is known in itself and not shown. This mechanism is provided to feed the thread in regular layers aternatively on each of the reels, in a continuous way, an already full reel being immediately put away and replaced by an empty reel.

The winding apparatus of the invention comprises means to detect a predetermined angular position of the clamp member (7 or 8) on the annulus (1 or 2) which is associated with the reel to be filled, the angular position being calculated with respect to the associated anvil (14 or 15). The apparatus also comprises means which are in themselves known, to initiate the travel of the thread 16 inside the clamp member 7 (or 8) immediately after the detection.

In the example of realisation which is shown, the invention provides for a detector 17, for example an inductive detector, supported by a fixed frame 18 and placed near the end of the shaft 6 on the opposite side of the annulus 2. The detector 17 is linked to an electric source, not shown, by wires 19 and faces the upper part of a washer 21 itself fixed at the end of shaft 6.

The washer 21 comprises near its periphery a mark which is, in the case of the example of realisation shown, an opening 22, which has a predetermined angular position with respect to the clamp member 8 of annulus 2. Hence the angular position of the opening 22 with respect to the clamp member 8 can have any value. Detection of the opening 22 by detector 17 when the opening 22 is carried before detector 17 provides then the value at this time of the angular position of the clamp member 8.

Shaft 5 is of course provided with the same detection means.

The working of the method of the invention by way of the apparatus which has just been described is as follows:

When the reel supported by the annulus 1 has received a predetermined length of thread detected by a control system, the control system initiates the displacement of the pulley of the traversing mechanism above the reel 9 to be filled. Thread 16 is hence brought near the flange 13 and near the annulus 2 (arrow F, FIG. 3), both of them rotating in an anti-clock wise direction when one looks from detector 17 toward annulus 2, with a speed equal to the winding speed of thread 16 (arrow F, FIG. 2).

When the thread 16 nears the plane P in which the projected end 23 of the clamp member 8 rotates (FIG. 3) opening 22 is carried before detector 17 when clamp member 8 occupies a position indicated by 8*a* on FIG. 1, position corresponding to the angle A. In the position 8*a*, clamp member 8 has then proceeded by nearly 15°, in the example of realisation shown, in an anti-clockwise direction (arrow G) after the anvil 15.

Detector 17 detects the passage of the clamp member 8 in its position 8*a* and initiates in a way known in itself a signal which allows the catch pin to carry thread 16 across plane P, i.e. closer to annulus 2 than the projected end 23 of clamp member 8 (arrow F', FIG. 3).

This motion must be completed when clamp member 8 passes again before anvil 15, after a rotation slightly inferior to a revolution. Preferably and for security reasons, all the parameters which are concerned are chosen in such a way that the travel of thread 16 inside clamp member 8 is carried out when clamp member 8 reaches a maximal angular position represented by 8*b* on FIG. 1, corresponding to an angle B. When in 8*b*, clamp member 8 is hence at a distance which corresponds to a security level; when this is not realised, a risk of meeting exists between thread 16 and projected end 23, if the travel of thread 16 further from projected end 23 has not been carried out when clamp member 8 reaches again 8*b*.

Angle B can be varied for example in function of the rotational speed of annulus 2 and in function of the value of the security margin which is to be respected. In the example of realisation shown this angle is of nearly 15°.

Immediately after the gripping of thread 16 by clamp member 8, the thread 16 is cut by anvil 15, and the filling of reel 9 begins, in a way known in itself. The process and the winding apparatus of the invention practically eliminate any risk of unwanted breakage of the thread 16 before the beginning of its winding around reel 9.

The above described method is repeated when reel 9 is filled and when annulus 1 carries a new empty reel to be filled.

As an example, the following numerical figures are given:

the annulus 2 rotates at 4000 RPM, and a complete rotation of the clamp member is hence achieved in 1/66 s. When the value of angles A and B is fixed at 15°, the travel of thread 16 must be carried out in less than 1/72 s, to avoid any risk of breakage of thread 16 by the projected end 23. When the diameter of thread 16 is chosen as being 1 mm (FIG. 3) the speed of translation of thread 16 must be well superior to 72 mm/s.

The method and the apparatus of the invention are not limited to the practical realisation which is shown; variations in the execution can be made. For example the signal which initiates the travel of thread 16 further from the projected end 23 can be initiated as soon as the clamp member 8 (or 7) has reached a predetermined angular position situated up-stream from anvil 15 (or 14). If the response time of the system which controls the travel of the thread is comprised between the intervals of time taken by the annulus to make one and two revolutions, one can then initiate the travel order when the clamp member (7 or 8) is still up-stream from the anvil (14, 15).

The interval of time in which the travel of thread 16 is made without any risks is hence increased. Practically, this interval can be comprised between the time taken by clamp member 8 (or 7) to make one revolution and the time taken by the clamp member to make two revolutions.

Figure 4:
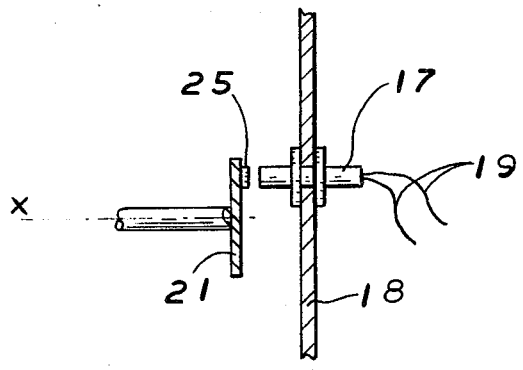
FIG. 4 is a diagrammatic partial side view showing another embodiment of the invention.
Figure 5:
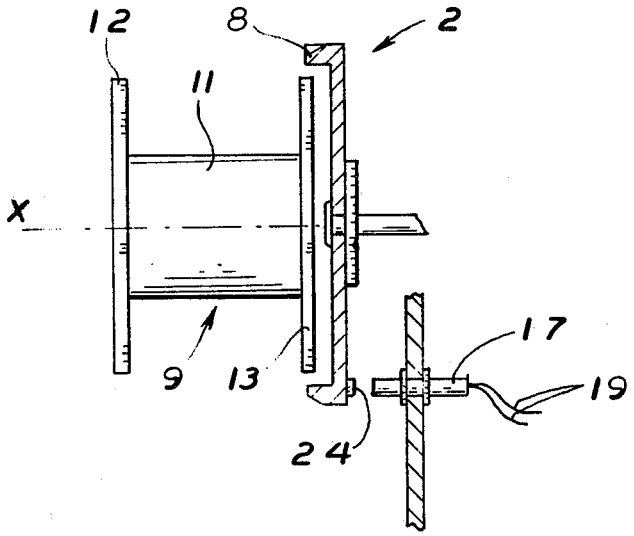
FIG. 5 is a diagrammatic partial side view showing a further embodiment of the invention in which the clamp member carries a distinctive mark.

The opening 22 can be replaced by a blade 25 fixed on the washer 21, the detector 17 being hence actuated by the material of the blade instead of being actuated by the opening (see FIG. 4). Detector 17 could also be placed near the corresponding annulus 2 (or 1) or near the clamp member 8 which would in this case carry a distinctive mark 24. (FIG. 5) The detector 17 could also be capacitive, electromagnetic or mechanical.

What I claim is:

1. A method to wind a thread on a succession of reels supported by coaxial annuli rotatively driven and fitted with a peripheral clamp member to couple the thread on the associated reels fixed on annuli, fixed anvils being provided to cut the thread when a reel has been filled to capacity, the switching-over of the thread from a filled reel to an empty reel being initiated after the detection of a predetermined angular position of the clamp member fixed on the annulus associated with the empty reel, this angular position being measured with respect to the associated anvil.

2. A method according to claim 1, where the switching of the thread is initiated immediately after detection of the passage of the clamp member at the level of the anvil, in such a way that the switching is carried out before a new complete revolution of the clamp member.

3. The method of claim 1, where in a signal allowing the switching of the thread is initiated as soon as the clamp member has reached a predetermined angular position situated up-stream from the anvil.

4. An apparatus to wind a thread, comprising two rotatively mounted annuli with parallel axes, each of them supporting a reel, each annulus being associated with a fixed anvil to cut the thread at the end of the filling of a reel, each annulus having at its periphery a clamp member to couple the thread with the reel, comprising means to detect a predetermined angular position of the clamp member fixed on the annulus associated with the reel to be filled, measured with respect to the associated anvil, and means to initiate the switching of the thread inside the clamp member immediately after the detection.

5. An apparatus according to claim 4, said annulus associated with the reel to be filled being fixed on the first end of a shaft, a washer being fixed on the second end of said shaft, a detector being placed in front of said washer, said washer carrying a mark which has a predetermined angular position with respect to the clamp member fixed on the annulus, the detector being such that it can detect the passages of the mark.

6. An apparatus according to claim 5, said mark being an opening in said washer.

7. An apparatus according to claim 5, said mark being a blade fixed on said washer.

8. An apparatus according to claim 4, the detector being positioned in front of said clamp member.

9. An apparatus according to claim 4, the detector being positioned in front of the annulus supporting said clamp member.

* * * * *